US007121630B1

(12) United States Patent
Ferley

(10) Patent No.: US 7,121,630 B1
(45) Date of Patent: Oct. 17, 2006

(54) SUBSTRATE PROTECTING MATERIAL REMOVING DEVICE

(76) Inventor: Shane Michael Ferley, 3600 Manly Rd., Goddard, KS (US) 67052

( * ) Notice: Subject to any disclaimer, the term of this patent is extended or adjusted under 35 U.S.C. 154(b) by 0 days.

(21) Appl. No.: 11/056,693

(22) Filed: Feb. 11, 2005

Related U.S. Application Data

(60) Provisional application No. 60/544,166, filed on Feb. 12, 2004.

(51) Int. Cl.
*B27C 1/14* (2006.01)
*E04D 15/02* (2006.01)

(52) U.S. Cl. ..... 299/39.1; 299/39.8

(58) Field of Classification Search ..... 299/39.1, 299/39.2, 39.8, 39.9; 144/114.1, 117.1, 218, 144/221
See application file for complete search history.

(56) References Cited

U.S. PATENT DOCUMENTS 1,949,482 A * 3/1934 Libertini ..... 299/39.8
4,009,908 A 3/1977 Alinder et al.
4,219,238 A * 8/1980 Sanchez ..... 299/39.8
4,269,450 A * 5/1981 Welborn ..... 299/39.8
4,673,219 A 6/1987 Perciful
5,800,021 A 9/1998 Derr
5,996,657 A * 12/1999 Riesselman ..... 144/235
2006/0016304 A1* 1/2006 Monyak ..... 83/13

* cited by examiner

*Primary Examiner*—John Kreck
(74) *Attorney, Agent, or Firm*—Robert O. Blinn

(57) ABSTRACT

A rotary reel material removal tool for removing an overlaid material from a substrate material includes a rotating cutting reel having blade members and non-cutting bumper members. The bumper members and the blade members are preferably arranged in a generally alternating and spaced manner around the outside of the cutting reel. The bumper members are set at a bumper diameter which is generally equal to or greater than the cutting diameter at which the blade members are set. When the reel is rotated at a sufficiently high rate on a generally flat, smooth substrate surface, the bumper members prevent the blade members from cutting into the smooth flat substrate. When the reel encounters the edges of overlaid materials which are layered on top of the substrate surface, such as, for example, roof shingles, the bumper members do not prevent the blade members from cutting into and removing the overlaid material.

18 Claims, 7 Drawing Sheets

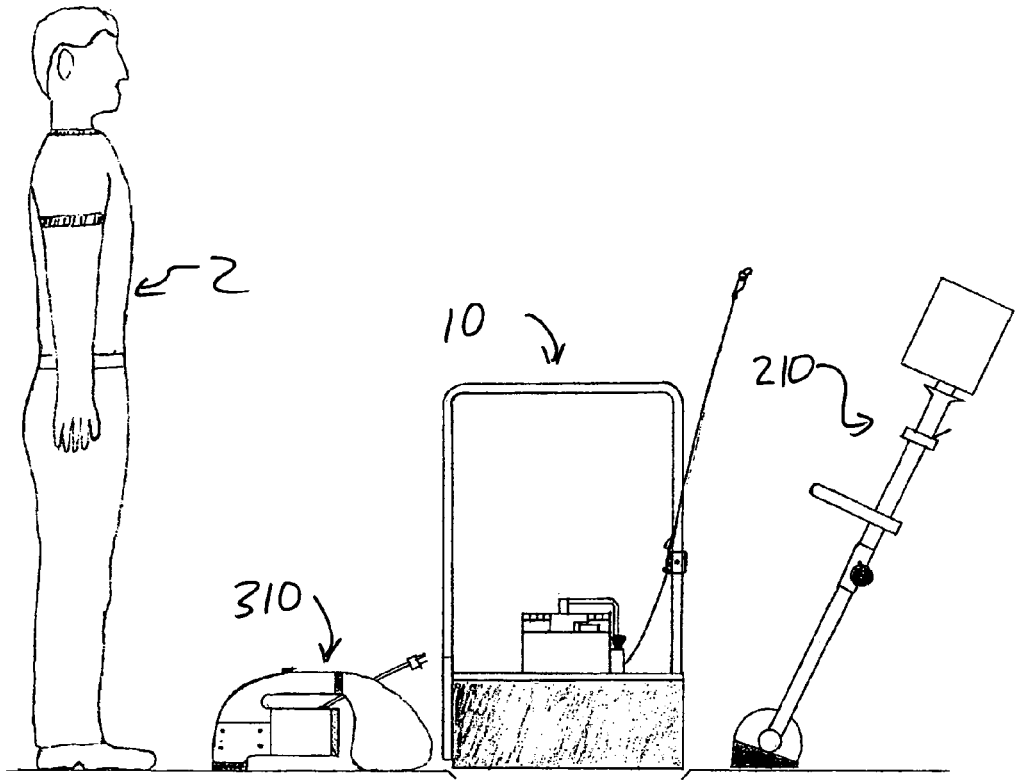
FIG. 8
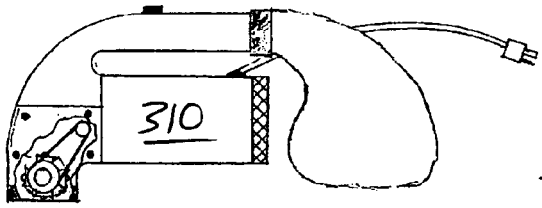
FIG. 9
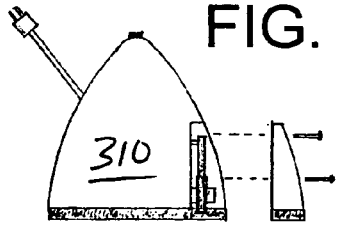
FIG. 10
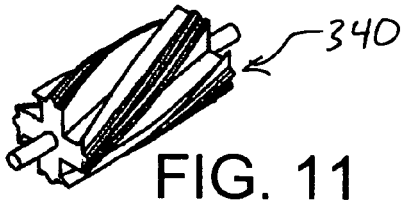
FIG. 11
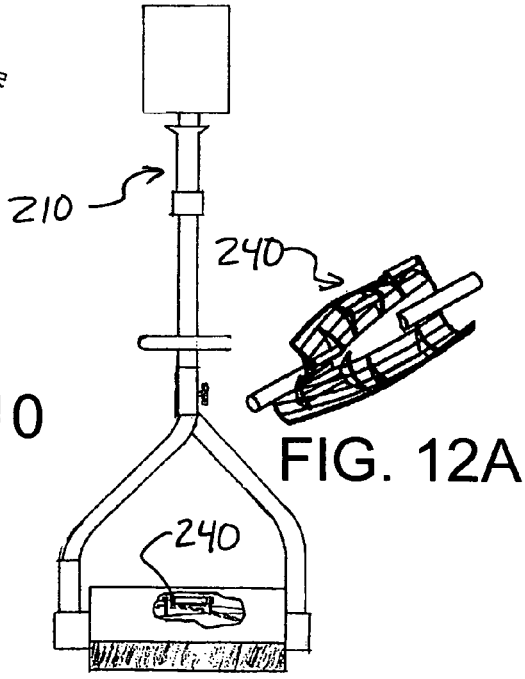
FIG. 12A
FIG. 12

SUBSTRATE PROTECTING MATERIAL REMOVING DEVICE

CROSS REFERENCES TO RELATED APPLICATIONS

This application claims the benefit of U.S. Provisional Patent Application No. 60/544,166 filed Feb. 12, 2004.

FIELD OF THE INVENTION

This invention relates to a device for removing overlaid material such as, for example, roof shingles from a substrate surface and more particularly to a device adapted to remove such overlaid material without damaging the substrate surface.

BACKGROUND OF THE INVENTION

Various material removing devices are known in the prior art. Such material removing devices might generally include a wheeled frame having a handle for manual control and guidance, a power source such as an internal combustion engine mounted to the frame and a cutting reel assembly driven by the power source which is equipped with radially mounted plates or blades for cutting and removing material. Such material removing devices are useful for such tasks as removing shingles from a roof substrate surface. A primary consideration in the configuration and operation of such material removing devices is to quickly strip unwanted material, such as old weathered shingles, while not damaging the underlying substrate surface. Material removing devices are typically configured so that the vertical position of the cutting reel can be carefully adjusted in relation to secondary supporting elements such as wheels or skids which support the frame of the device. One difficulty in this approach is that secondary supporting elements may ride either upon stripped or unstripped surfaces thus varying the vertical position of the cutting reel. Accordingly, what is needed is a material removing device which, without the aid of secondary supporting elements, is inherently configured to remove overlaid material from a substrate while not penetrating and damaging underlying substrate material.

BRIEF DESCRIPTION OF THE INVENTION

The aforementioned need is addressed by providing a material removing device for removing overlaid material from a substrate. The material removing device includes a frame, a cutting reel rotatably mounted to the frame and a power source for turning the cutting reel. The cutting reel includes a shaft and radially extending support members for supporting blade members and bumper members which are arranged in an alternatingly spaced fashion. The blade members present cutting edges for cutting overlaid material. The bumper members present generally smooth non-cutting surfaces for non-cutting contact with substrate material. The cutting edges of the blade members are set at a cutting diameter and the non-cutting surfaces of the bumper members are set at a bumper diameter which preferably is generally equal to or slightly greater than the cutting diameter. When the cutting reel is initially placed on a portion of substrate surface which has been cleared of overlaid material and then activated to rotate within a predetermined speed range and guided into an adjacent area having an overlaid material such as roof shingles, the blade members cut and remove the overlaid material while the bumper members make smooth, non-cutting contact with the substrate material thereby preventing the cutting and damaging of the substrate material. Accordingly, the material removing device is a particularly effective tool for removing a relatively rough, brittle or uneven overlaid material from a relatively flat and smooth substrate surface.

BRIEF DESCRIPTION OF THE DRAWINGS

FIG. 8 shows various devices which could apply various embodiments of the cutting reel of the present invention, including a Front view of the FIG. 1 embodiment.

FIG. 9 is a side view of one of the embodiments shown in FIG. 8.

FIG. 10 is an end view of the embodiment shown in FIG. 9.

FIG. 11 is a perspective view of the cutting reel used in the embodiment shown in FIG. 9.

FIG. 12 is a front view of one of the embodiments shown in FIG. 8.

FIG. 12A is a perspective view of the cutting reel used in the embodiment shown in FIG. 12.

DETAILED DESCRIPTION

Figure 1:
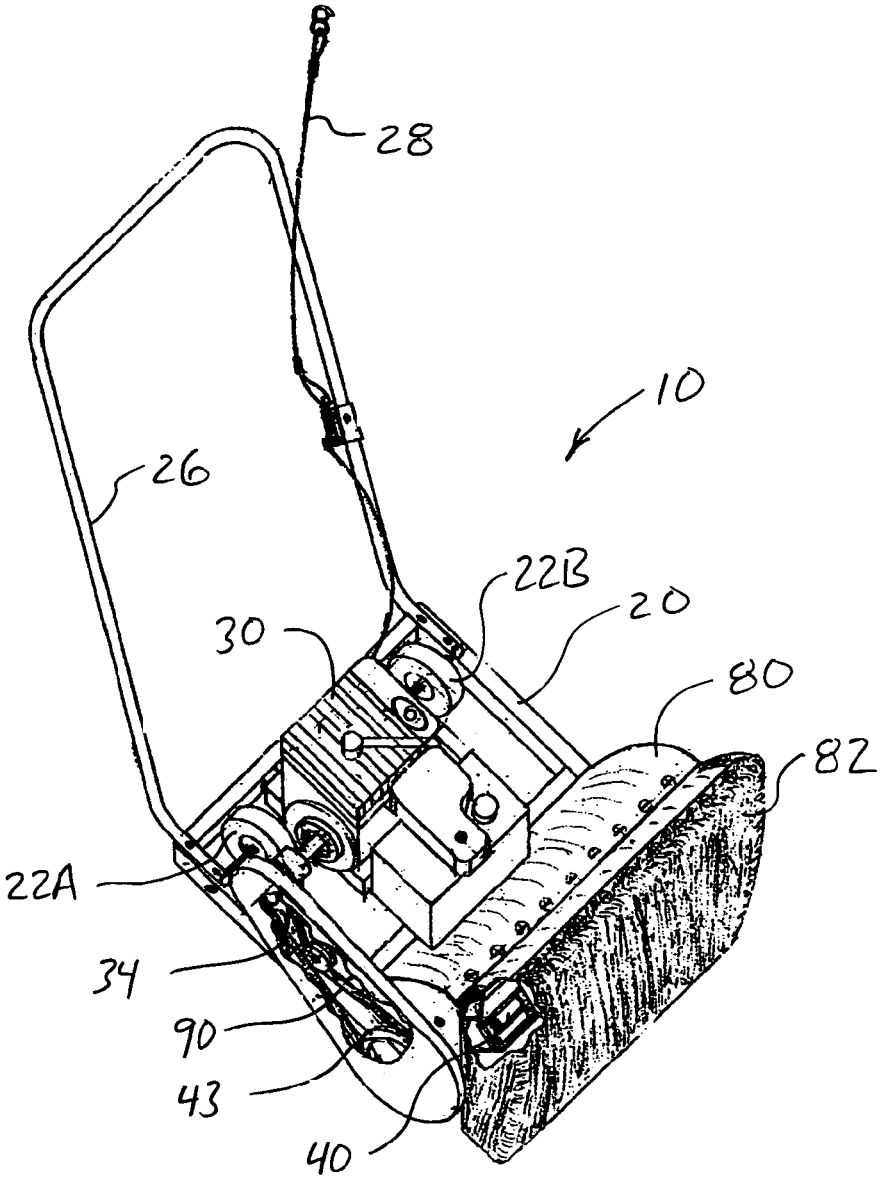
FIG. 1 is a perspective view of an example embodiment of the material removing device of the present invention.
Figure 2:
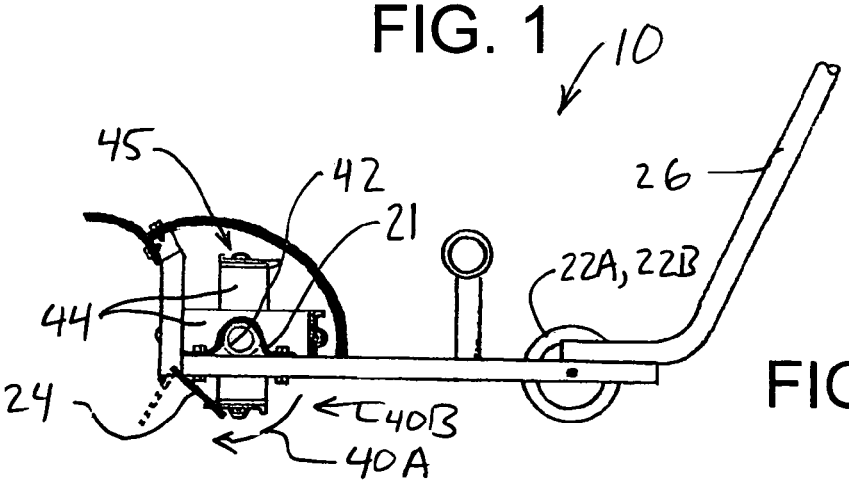
FIG. 2 is a side view of an example embodiment of the material removing device of the present invention.

Referring to FIG. 1, an embodiment of a material removing device 10 is shown to generally include a frame 20, a power source such as engine 30, a cutting reel 40 and a belt drive 80 for transferring power from power source 30 to cutting reel 40. Engine 30, in this example, is an internal combustion engine which is mechanically associated with cutting reel 40 by a belt drive 90. Generally frame 20 is arranged to support engine 30 and cutting reel 40. Frame 20 includes a handle 26 which is shaped for manipulation by an operator The various elements of material removing device 10 function to support and power cutting reel 40 and more particularly to present cutting reel 40 for contact with overlaid material so that such overlaid material is dislodged and removed from a substrate surface. As will be described below, cutting reel 40 is particularly configured, such that when it is brought in rotating contact with an overlaid material, it removes the overlaid material while not damaging or cutting the underlying substrate material. As is shown in FIG. 1, engine 30 is fixed to frame 20 and as can be seen in FIG. 2, cutting reel 40 is rotatably mounted to frame 20 for rotation about a cutting reel shaft 42. Direction arrow 40A shows the direction of rotation of cutting reel 40 during normal operations. Frame 20 is supported by two wheels 22A and 22B. A first drive pulley 34 is mounted to engine 30 and a second drive pulley 43 is mounted to one end of shaft 42. A drive belt 90 connecting between first drive pulley 34 and second drive pulley 43 transfers power from engine 30 to cutting reel 40.

Cutting reel 40 is enclosed by a cowling 80. A flexible shroud 82 is fixed to the front end of cowling 80. Flexible shroud 82 is adapted to allow the passage of ejected material. A spring biased starting stand 24 is pivotably mounted to the forward end of frame 20 and supports cutting reel 40 in a raised position for starting engine 30. Starting stand 24 will swing into a forward starting position when the operator pivots frame 20 about wheels 22A and 22B to lift the cutting reel end of material removing device 10. Once engine 30 has started, an operator may push frame 20 forward to cause retraction of starting stand 24.

Figure 3:
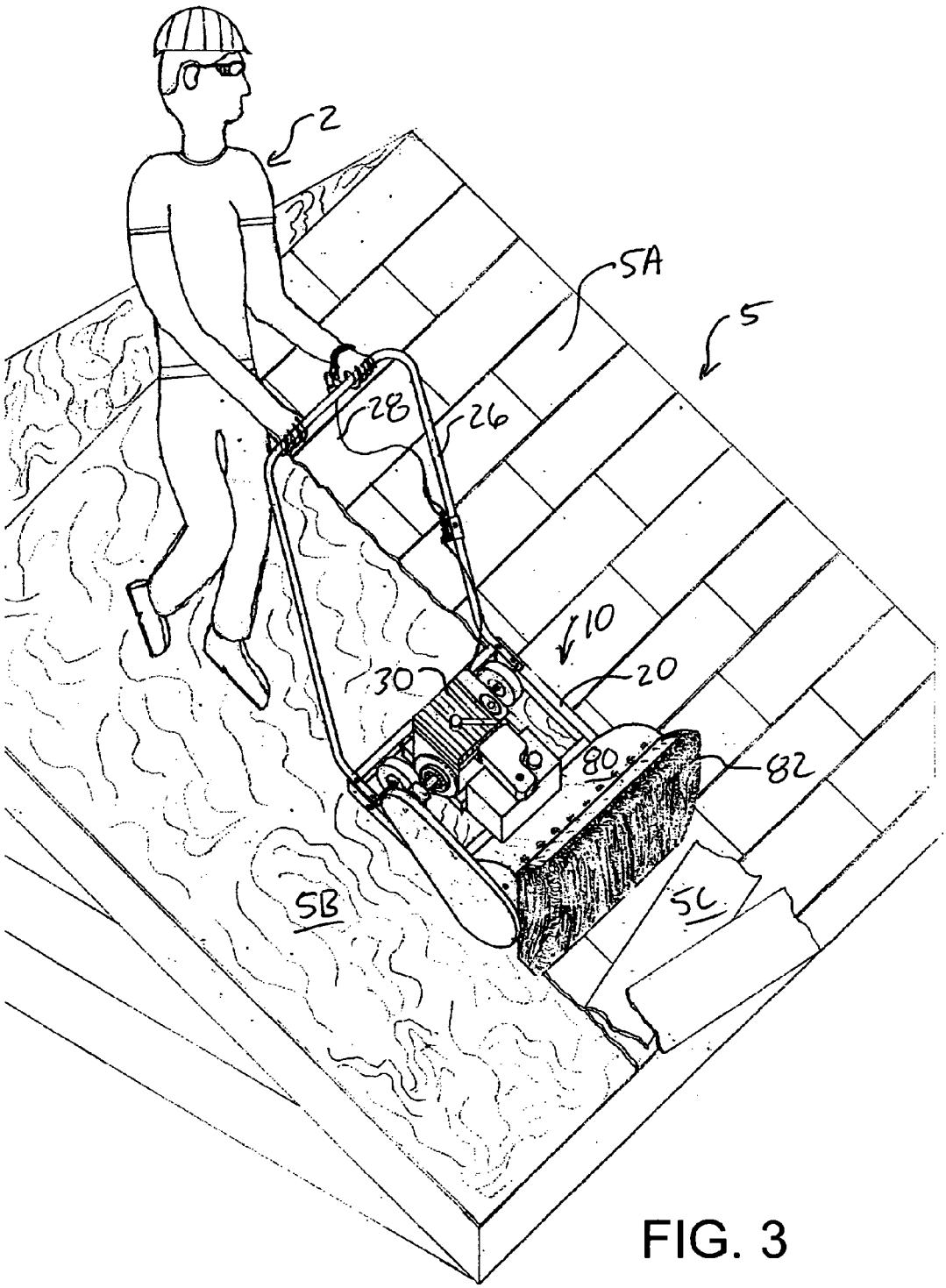
FIG. 3 is a perspective view of an example embodiment of the material removing device shown removing shingles from a roof surface.

FIG. 3 illustrates material removing device 10 being used by an operator 2 to remove shingles 5A from a substrate surface 5B of a roof 5. As can be seen in FIG. 3, operator 2 is grasping handle 26 in order to control the movement of material removing device 10. Removed shingles 5C are being kicked forward under flexible shroud 82. An emergency shut off lanyard 28 connects between engine 30 and the wrist of operator 2. A loss of control of material handling device 10 or separation of material handling device 10 and operator 2 will cause a separation of lanyard 29 and an automatic shut down of engine 30.

Figure 4B:
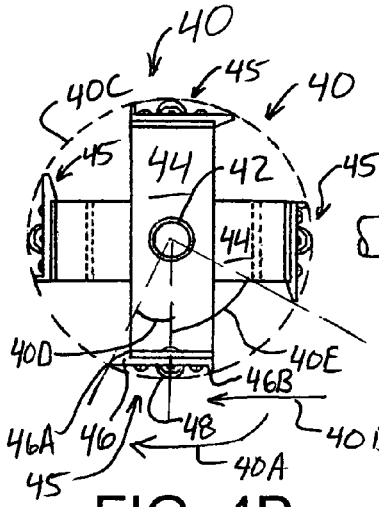
FIG. 4B is an end view of the first embodiment of the cutting reel for the material removing device shown in FIG. 4A.
Figure 4A:
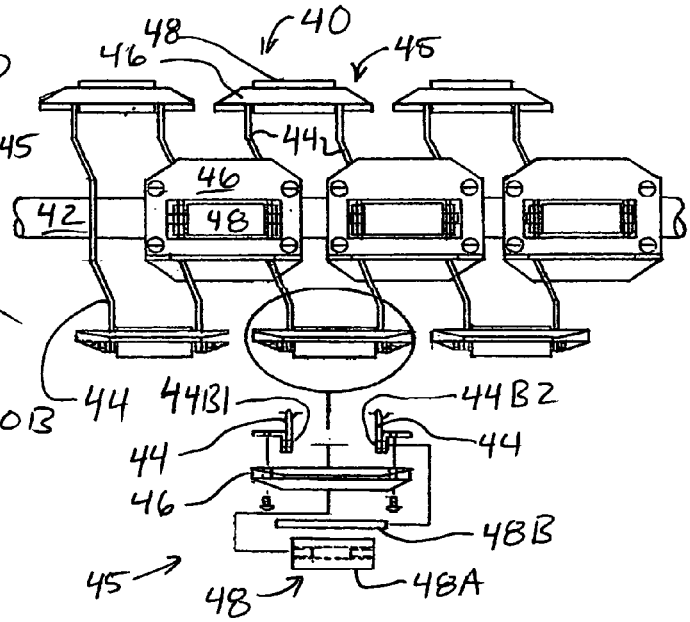
FIG. 4A is a front view of a first embodiment of a cutting reel for the material removing device.
Figure 5B:
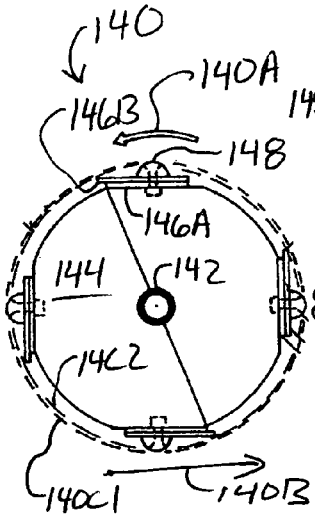
FIG. 5B is an end view of the second embodiment of the cutting reel for the material removing device shown in FIG. 5A.
Figure 5A:
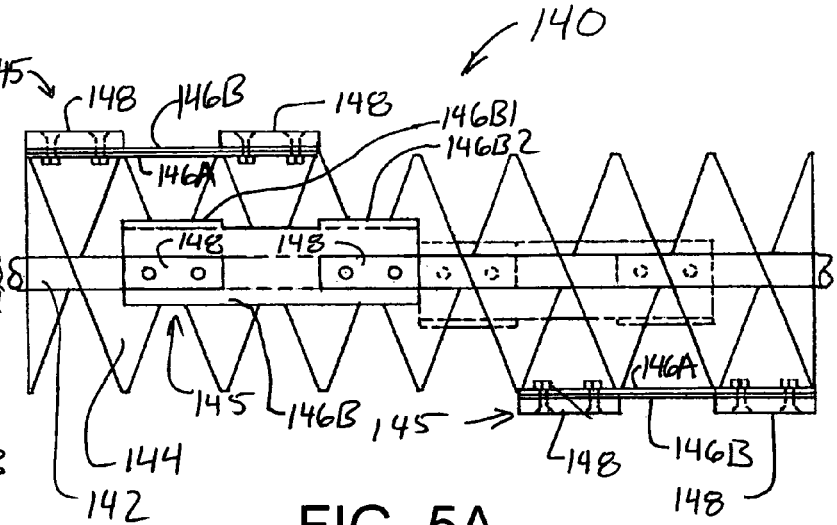
FIG. 5A is a front view of a second embodiment of a cutting reel for the material removing device.

Cutting reel 40 of material removing device 10 can be seen in FIG. 2 and is shown in greater detail in FIGS. 4A, and 4B. As noted above, cutting reel 40 is designed to cut, damage and remove overlaid material while not damaging underlying substrate material. Cutting reel 40 is particularly useful for removing shingles from a roof surface as shown in FIG. 3. FIGS. 1, 2, 4A and 4B show that cutting reel 40 includes a shaft 42 which is rotatably mounted by bearings 21 to frame 20. The direction of rotation for cutting reel 40 is indicated in both FIGS. 2 and 4B by direction arrow 40A. The direction of travel for cutting reel 40 is indicated in both FIGS. 2 and 4B by direction arrow 40B. As can be best seen in FIGS. 4A and 4B, cutting reel 40 includes a series of radially staggered support members 44. Support members 44 are preferably rigidly welded to shaft 42 for supporting a pattern of blade and bumper assemblies 45. As can be best seen in FIGS. 4A and 4B, blade and bumper assemblies 45 are preferably evenly distributed both radially and longitudinally about the periphery of cutting reel 40. Radial angle 40D in FIG. 4B indicates the radial angle between the cutting edge of a blade portion 46A and a following bumper member 48 in the direction of rotation indicated by direction arrow 40A. Radial angle 40E in FIG. 4B indicates the radial angle between a bumper member 48 and the next following cutting edge of the next blade portion 46A in the direction of rotation indicated by direction arrow 40A. It is preferable, as is shown in FIG. 4B, that the blade to following bumper angle 40D be significantly less than the bumper to following blade angle 40E.

FIG. 4A also presents other details of each blade and bumper assembly 45. Each blade and bumper assembly 45 includes a blade member 46 and a bumper portion 48. Blade member 46 further includes a forward blade portion 46A and a following kicker portion 46B. In the case of cutting reel 40, blade portions 46A have relatively sharp leading edges designed for biting into overlaid material which are set to follow a cutting diameter. Kicker portions 46B are relatively blunt structures adapted for following behind blade portions 46A and for sweeping loosened overlaid material. Kicker portions 46B may be fashioned from flexible brush like elements.

The details of the bumper portion of blade and bumper assembly 45 are shown in exploded detail in FIG. 4A. As can be seen in the exploded portion of FIG. 4A, bumper portion 48 includes a cylindrical roller 48A which is rotatably mounted to adjacent support members 44 by an axle 48B. Axle 48B is received by opposite holes 44B1 and 44B2 of adjacent support members 44 and is constrained from longitudinal movement by blade member 46 which is bolted to the same adjacent support members 44. Blade portion 46A, roller 48A and kicker portion 46B are spaced radially about cutting reel 40 such that they make contact with substrate material at substantially the same radius as indicated by a phantom circle 40C in FIG. 4B. Accordingly, as cutting reel 40 rotates the outermost cutting edges of blade portion 46A follows a cutting diameter while the outer surfaces of rollers 48 follow a bumper diameter. In the case of cutting reel 40, rollers 48 follow a bumper diameter which is generally the same as cutting diameter followed by the cutting edges of blade portions 46A. Accordingly, in the case of cutting reel 40, the cutting diameter and the bumper diameter are both represented by phantom circle 40C in FIG. 4B. Kicker portions 46B are shown in FIG. 4B to also follow phantom circle 40C, However, since kicker portions 46B may be fashioned from flexible brush like elements, they can extend beyond the bumper diameter or cutting diameter and perform their sweeping function without damaging the substrate surface.

The above described diametric positioning of each blade portion 46A, roller 48A and kicker portion 46B of each of the blade and bumper assemblies 45 of cutting reel 40 is important to the operation of cutting reel 40. This arrangement is adapted so that the cutting portions of a blade and bumper assembly will damage, bite into and remove relatively uneven overlaid materials such as roof shingle while the bumper portion will, upon encountering a relatively smooth and level substrate material, prevent the further cutting and damage of a substrate surface. (This is not to say that a substrate material will always be perfectly unscathed but rather that, when operated by a skilled operator, material removing device 10 will remove overlaid material while leaving substrate material sufficiently undamaged so as to not require repair or replacement.) In the case of cutting reel 40, which is adapted for removing roof shingles, a cutting real diameter between six and twelve inches is preferable and a speed of operation of approximately 1000 RPM is preferred. Accordingly, for cutting reel 40, a preferred cutting speed approximately between 20 to 40 feet per second. Cutting speed should be understood in this connection as the relative speed at which blade and bumper assemblies encounter overlaid material.

FIGS. 5A–7B illustrate alternate embodiments of cutting reels, namely cutting reel 140, cutting reel 240 and cutting reel 340. Cutting reel 140 shown in FIGS. 5A and 5B. Cutting reel 140 includes a shaft 142 which carries an auger assembly 144. Auger assembly 144 serves the same function as support members 44 of cutting reel 40 described above, namely supporting blade and bumper assemblies. Yet auger assembly 144 may also function to push or eject loose, removed material in a transverse direction generally parallel to shaft 142. A pattern of blade and bumper assemblies 145 is fixed to the outer edges of auger assembly 144. Each blade and bumper assembly 145 includes a blade support member 146A which is preferably welded to auger assembly 144. A blade member 146B is fastened to each blade support member 146A. Each blade member 146B includes two projecting blade portions 146B which present two forward cutting edges 146B1 and 146B2. Two bumper members 148 are also fastened with blade member 146B to blade support member 146A. This design accommodates the periodic removal and replacement of blade members and 146B and bumper members 148. Direction arrow 140A indicates the direction of rotation for cutting reel 140 while travel direction arrow 140B indicates the direction of travel for cutting reel 140. Phantom circle 140C1 indicates the bumper diameter followed by bumper members 148. Phantom circle 140C2, which is inscribed slightly inside phantom circle 140C1, indicates the cutting diameter followed by the outermost limits of forward cutting edges 146B1 and 146B2. In this embodiment the bumper diameter is slightly larger than the cutting diameter.

Figure 6A:
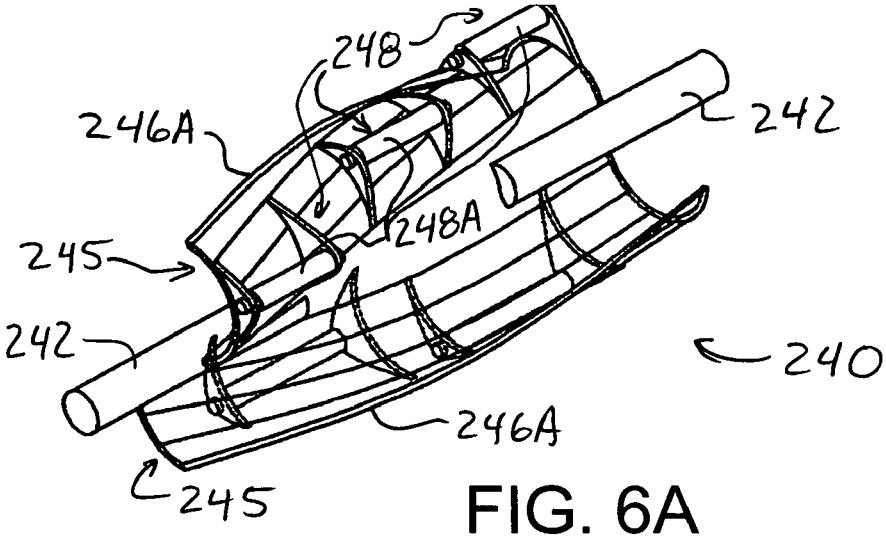
FIG. 6A is a perspective view of a third embodiment of a cutting reel for the material removing device.
Figure 6B:
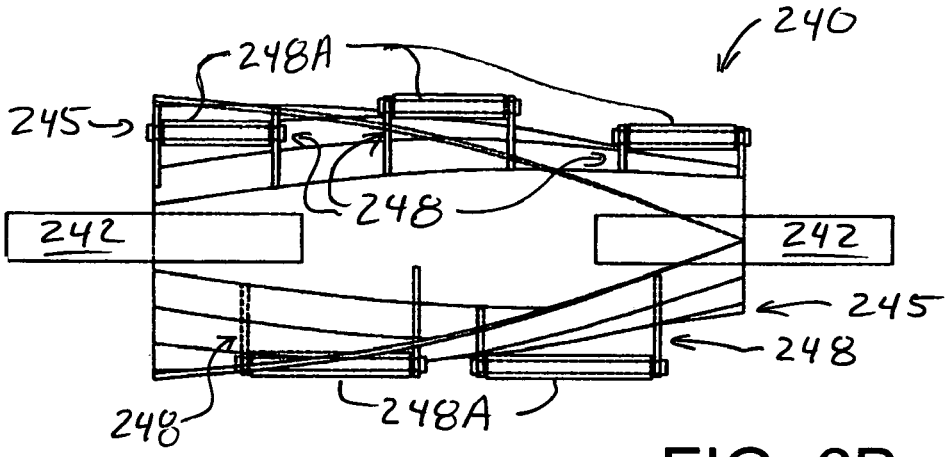
FIG. 6B is a front view of the third embodiment of the cutting reel for the material removing device shown in FIG. 6A.
Figure 6C:
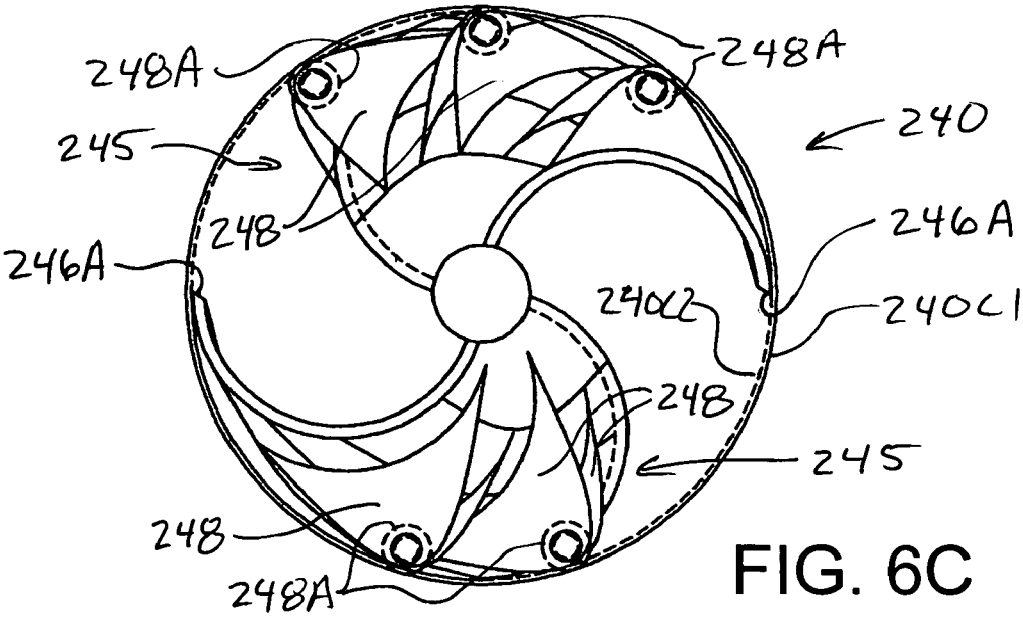
FIG. 6C is an end view of the third embodiment of the cutting reel for the material removing device shown in FIGS. 6A and 6B.

Cutting reel 240 shown in FIGS. 6A–6C features cutting assemblies 245 which spiral about a central shaft 242 in a helical fashion. Mounted in an evenly space manner on each cutting assembly 245 are three roller assemblies 248 including rollers 248A which are oriented generally parallel to shaft 242. The advantage of this configuration is that the forward cutting edge 246A of each cutting blade assembly 245 encounters overlaid material at a pitched cutting angle. Rollers 248A functions as rollers 48 of reel 40 by preventing forward cutting edges 246A from penetrating substrate material. Phantom circle 240C1 indicates bumper diameter followed by the outer most portions of bumper members 248. Phantom circle 240C2, which is inscribed slightly inside phantom circle 240C1 indicates the cutting diameter followed by the cutting edges of blade members 246. Accordingly, in this embodiment, the bumper diameter is slightly greater than the cutting diameter. By way of example, the applicant envisions that this type of cutting reel may be used in a smaller handle mounted material removing device such as material removing device 210 as shown in FIGS. 8 and 12.

Figure 7A:
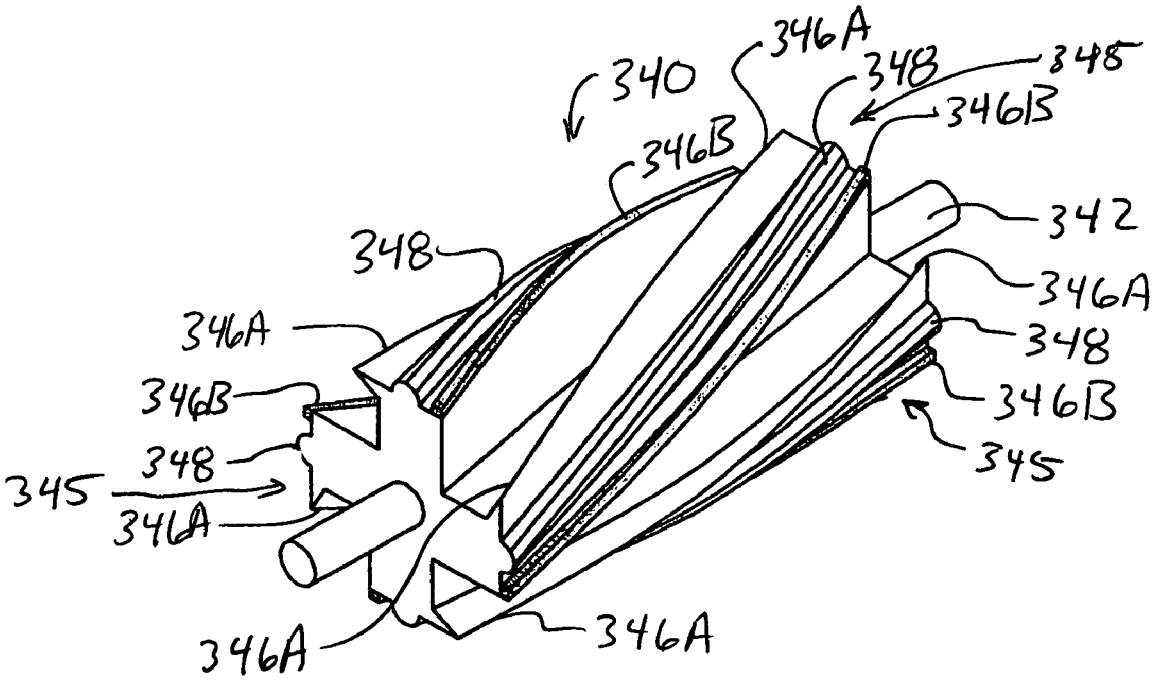
FIG. 7A is a perspective view of a fourth embodiment of a cutting reel for the material removing device.
Figure 7B:
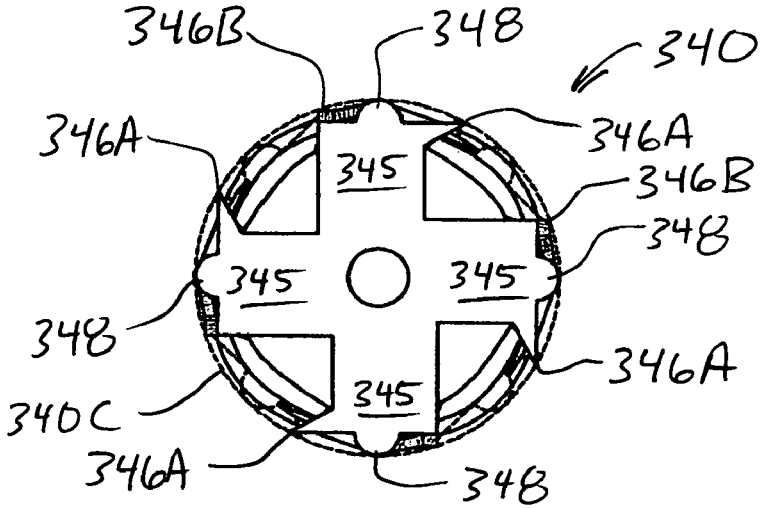
FIG. 7B is an end view of the third embodiment of the cutting reel for the material removing device shown in FIG. 7A.

Cutting reel 340 shown in FIGS. 7A and 7B features integrated blade and bumper members 345 projecting in an evenly spaced helical manner from a central shaft 342. Blade and bumper members 345 include a leading cutting edge portion 346A, a bumper portion 348 and a kicker portion 346B. As with cutting real 240, the leading edges of the cutting edge portions 346A encounter overlaid material at a pitched cutting angle. Bumper portions 348 prevent excessive cutting and damage to substrate material essentially as described above with the previously described cutting reels. Kicker portions 346B function much like kicker portions 46B of reel 40 by pushing and sweeping loose material forward. Kicker portions 346B may be made from a flexible material such a nylon brush. By way of example, the applicant envisions that this type of cutting reel may be used in a small hand held material removing such as material removing device 310 shown in FIGS. 9–11.

Cutting reels 40, 140, 240 and 340 share common analogous structures, namely, blade members and trailing bumper members. Preferably, for any particular cutting reel, bumper members and blade members should be arranged such that bumper diameter followed by the bumper members is generally equal to or greater than the cutting diameter followed by the cutting edges of the blade members. A cutting reel may have many blade members with many cutting edges and the cutting edges may presented by permanent elements or may be presented by removable and replaceable elements. Blade members and bumper members are preferably spaced around the cutting reel in an alternating fashion with the bumper members preferably located at least every 90 degrees. It is preferably that bumper member not be located more than 180 degrees apart. It is also preferable that the angle between the cutting edge of a blade member and a following bumper member be substantially smaller than the angle between a bumper member and the next cutting edge. This relatively small following angle for bumper members relative to cutting edges is found in cutting reels 40, 140, 240 and 340 described above and shown in FIGS. 4B–7B.

Figure 13A:
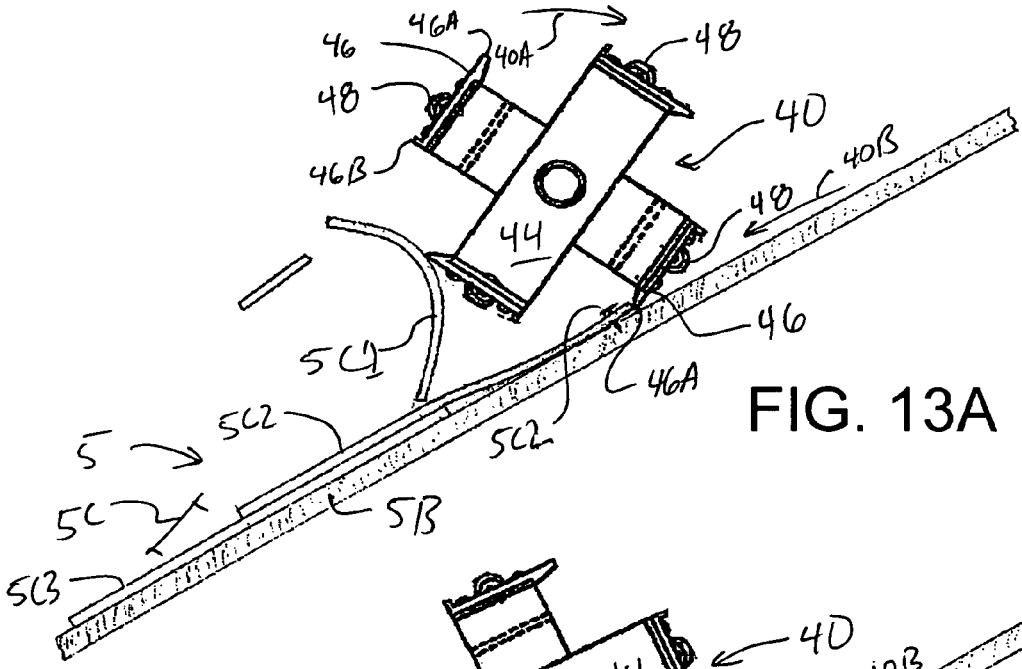
FIG. 13A is an first end view of cutting reel 40 removing overlaid shingles from a substrate roof structure.
Figure 13B:
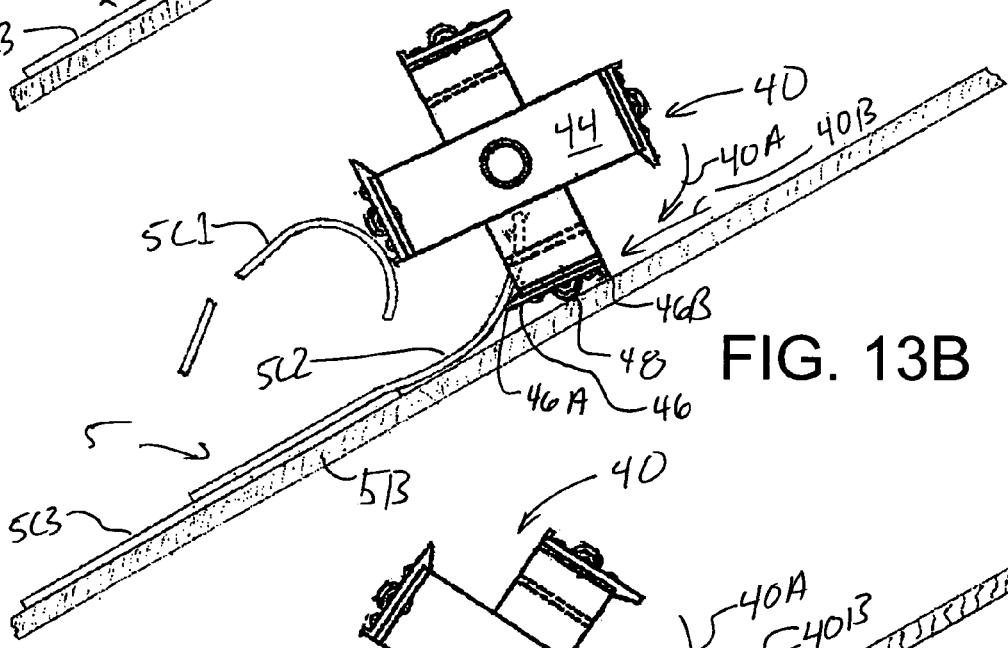
FIG. 13B is an second end view of cutting reel 40 removing overlaid shingles from a substrate roof structure
Figure 13C:
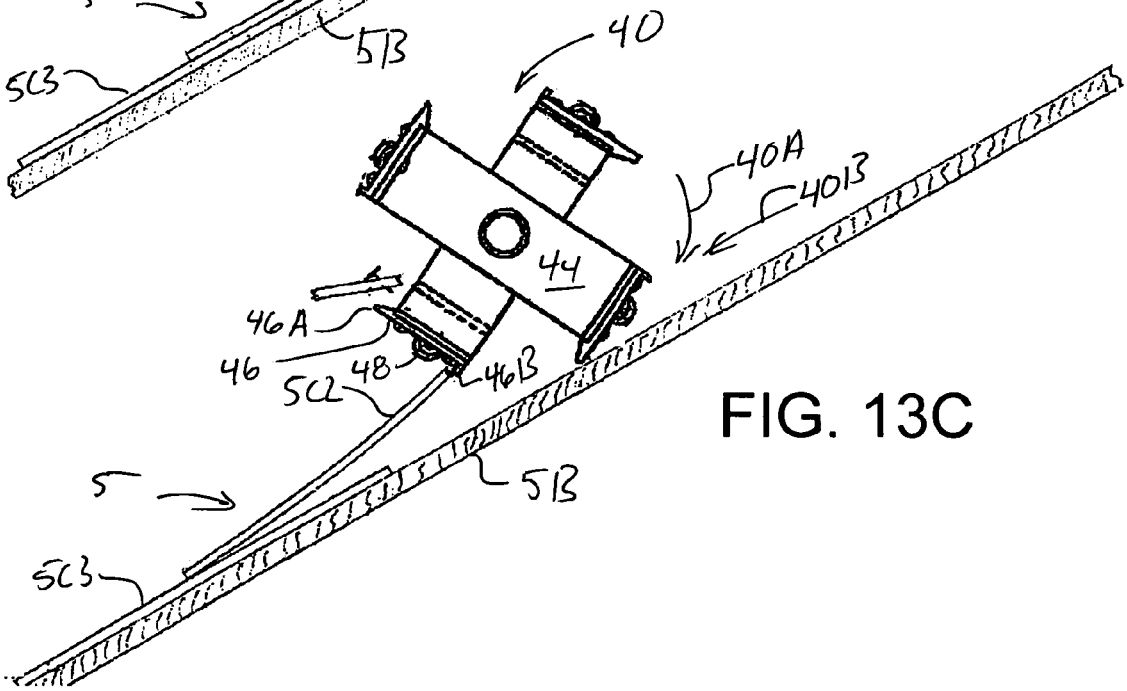
FIG. 13C is an third end view of cutting reel 40 removing overlaid shingles from a substrate roof structure.

FIGS. 13A–13B illustrate the interaction between a cutting reel 40 and a roof structure 5. In FIGS. 13A–13B, roof structure 5 includes a smooth, relatively flat, substrate surface 5B which is covered by overlaid material 5C, which in this case is a pattern of shingles 5C1, 5C2 and 5C3. FIG. 13A shows that it is preferable to begin the operation of cutting reel 40 on a smooth, cleared portion of substrate surface 5B. Reel 40 can rotate upon smooth, generally flat substrate surface 5B for an indefinite period of time as bumpers 48 prevent the cutting edges of blade portions 46A from cutting into substrate surface 5B. However, as reel 40 moves forward in the direction of arrow 40B, the cutting edge of blade portion 46A encounters or catches the edge of shingle 5C2 and begins pealing shingle 5C2 from substrate 5B. At the same time, as shown in FIG. 13A, another blade member 46 is completing the removal of shingle 5C1. FIGS. 13B and 13C illustrate the progression of this process as shingle 5C2 is removed and destroyed. In FIG. 13C, kicker portion 46B is shown catching a broken edge of shingle 5C2 thus causing the further removal of shingle 5C2. As can be seen in FIGS. 13A–13C, if the cutting diameter of reel 40 is greater than the bumper diameter, then the cutting edges of blade portions 46A will cut into substrate surface 5B. Conversely, if the cutting diameter of reel 40 is less than the bumper diameter, then the cutting edges of blade portions 46A will not cut into substrate 5B. However, if the cutting diameter of reel 40 is too small in comparison to the bumper diameter, then the cutting edges of blade portions 46A may miss the exposed edges of overlaid shingles 5C1, 5C2 and 5C3 entirely. Accordingly, the optimal configuration is one such that when cutting reel 40 is rotated at a pre-selected rate, the cutting edges of blade portions 46A just miss making contact with substrate 5B but make maximum contact with the edges exposed edges of the overlaid material, which in this case is a pattern of shingles, as portions of that overlaid material are progressively removed. The skilled reader should understand, that FIGS. 13A–13C are merely the applicant's best attempt to illustrate the high speed operation of reel 40. The skilled reader should appreciate that the reel 40 rotates at a relatively high speed and that the cutting, destruction and removal of shingles may occur in smaller increments than shown and at much higher speeds than these figures might suggest.

The skilled reader may envision numerous ways to drive a cutting reel. For example, material removing device 10 uses an internal combustion engine 30 in combination with a belt drive system. Material removing device 210 might use either an electric motor or small internal combustion engine in combination with a power transmission system of the type used in trimming devices. The hand held material removing device 310 uses a small electric motor and a belt drive arrangement as shown in FIG. 10. In any case, sufficient power must be available and transmitted to the cutting reel to maintain the cutting reel at a speed of rotation sufficient for cutting and removing overlaid materials while also allowing the bumper members to prevent the blade members from inflicting excessive damage to underlying substrate surfaces. The applicant recommends that cutting reels of less than six inches in diameter rotate at speeds generally greater than 1000 RPM, that cutting reels of between six and twelve inches in diameter rotate at approximately 1000 RPM and that cutting reels of greater than twelve inches in diameter rotate at generally less than 1000 RPM.

The various examples shown and described above should give the skilled reader insight regarding the many design choices available to a designer of a cutting reel and a material removing device in accordance with the present invention. Those skilled in the art will appreciate that materials for blade members and bumper members should be selected for strength and durability. Designers of cutting reels may prefer to design cutting reels which accommodate the periodic removal and replacement of blades and bumpers. On the other hand, one piece cutting reels such as cutting reel 340 may be indicated for small hand held applications where the periodic replacement of the entire cutting reel may be more practical and cost effective. Common to cutting reels of the present invention will be a shaft, blades and bumper members and structures such as support members for supporting the blades and the bumper members. Cutting reels of the present invention should be configured such that the outermost surfaces of the bumper members, when rotating, follow a bumper diameter which is generally equal to or greater than the cutting diameter followed by the cutting edges of the blades.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A material removing device for removing an overlaid material from a substrate material, said material removing device comprising:

(a) a frame, (b) a power source, (c) a cutting reel including (i) a shaft rotatably mounted to said frame and mechanically associated with said power source for powered rotation, (ii) support members fixed to said shaft and (iii) blade members and bumper members fixed to said support members and arranged in an alternating spaced fashion, said blade members presenting cutting edges set at a cutting diameter for cutting said overlaid material, said bumper members presenting generally smooth non-cutting surfaces set at a bumper diameter which is generally equal to or greater than said cutting diameter, whereby when said cutting reel is rotated, said blade members cut and remove said overlaid material while said bumper members contact said substrate surface and thereby prevent damaging contact between said cutting edges of said blade members and said substrate surface.

2. The material removing device of claim 1, wherein: at least the cutting edge of each of said blade members describes a helix about said shaft of said cutting reel.

3. The material removing device of claim 1, wherein: said bumper members are cylindrical rollers mounted to said support members of said cutting reel.

4. The material removing device of claim 1, wherein: cutting reel further comprises blunt kicker portions which are disposed in spaced following relationships to said bumper members.

5. The material removing device of claim 1, wherein: the cutting reel further comprises blunt kicker portions which are disposed in spaced following relationships with said bumper members and wherein said kicker portions are fashioned from a relatively flexible material.

6. A material removing device for removing an overlaid material from a substrate material, said material removing device comprising:

(a) a frame, (b) a power source, (c) a cutting reel including (i) a shaft rotatable mounted to said frame and mechanically associated with said power source for powered rotation, (ii) support members fixed to said shaft and (iii) blade members and bumper members fixed to said support members and arranged in an alternating spaced fashion, said blade members presenting cutting edges set at a cutting diameter for cutting said overlaid material, said bumper members presenting generally smooth non-cutting surfaces set at a bumper diameter which is generally equal to or greater than said cutting diameter, whereby when said cutting reel is rotated, said blade members cut and remove said overlaid material while said bumper members contact said substrate surface and thereby prevent damaging contact between said cutting edges of said blade members and said substrate surface, said blade members and said bumper members arranged such that the radial angle between the cutting edge of a blade member and a following bumper member in the direction of rotation of said cutting reel is substantially smaller than the radial angle between a bumper member and a following cutting edge of a next blade member in the direction of rotation.

7. The material removing device of claim 6, wherein: said blade members are removable and replaceable.

8. The material removing device of claim 6, wherein: said bumper members are removable and replaceable.

9. The material removing device of claim 6, wherein: said blade members and said bumper members are removable and replaceable.

10. The material removing device of claim 6, wherein: said blade members and said bumper members are incorporated into integral blade and bumper members each having a blade portion and a bumper portion.

11. The material removing device of claim 6, wherein: at least the cutting edge of each of said blade members describes a helix about said shaft of said cutting reel.

12. The material removing device of claim 6, wherein:

said blade members and said bumper members are incorporated into integral blade and bumper members each having a blade portion and a bumper portion and said blade and bumper members are disposed in a helical fashion around said cutting reel.

13. The material removing device of claim 6, wherein;

said bumper members are cylindrical rollers mounted to said support members of said cutting reel.

14. The material removing device of claim 6, wherein:

said bumper members are cylindrical rollers mounted to said support members of said reel and said blade members are each shaped to describe a helix.

15. A material removing device for removing an overlaid material from a substrate material, said material removing device comprising:

(a) a frame, (b) a power source, (c) a cutting reel including (i) a shaft rotatably mounted to said frame and mechanically associated with said power source for powered rotation, (ii) support members fixed to said shaft and (iii) blade members and bumper members fixed to said support members and arranged in an alternating spaced fashion, said blade members presenting cutting edges set at a cutting diameter for cutting said overlaid material, said bumper members presenting generally smooth non-cutting surfaces set at a bumper diameter which is generally equal to or greater than said cutting diameter, whereby when said cutting reel is rotated, said blade members cut and remove said overlaid material while said bumper members contact said substrate surface and thereby prevent damaging contact between said cutting edges of said blade members and said substrate surface, and, (iii) blunt kicker portions which are disposed in spaced following relationships to said bumper members.

16. The material removing device of claim 15, wherein:

cutting reel further comprises blunt kicker portions which are disposed in spaced following relationships with said bumper members and wherein said kicker portions are fashioned from a relatively flexible material.

17. A method for removing overlaid material from a substrate surface comprising:

a. Obtaining a cutting reel including a central shaft for powered rotation, support members fixed to said shaft and a plurality of blade members and bumper members fixed to said support members, said blade members having cutting edges which follow a cutting diameter and said bumper members having outer surfaces which follow a bumper diameter generally equal to or greater than said cutting diameter such that when said cutting reel is rotated at a pre-selected speed of rotation on a generally flat substrate surface, said cutting edges of said blade members do not cut into said substrate surface and such that said cutting edges of said blade members will cut into adjacent material overlaid on said substrate surface, said cutting reel further comprises kicker portions fixed to said support members in following relationships with said bumper members, b. positioning said cutting reel upon a portion of said substrate surface which is relatively free of said overlaid material, c. activating said cutting reel to cause rotation thereof, d. translating said cutting reel into an area having overlaid material such that said cutting edges of said cutting members of said cutting reel encounter an edge of said overlaid material and cut into and destroy said overlaid material and peal said overlaid material away from said substrate while said bumper members prevent similar cutting and damage to said substrate material, said kicker portions sweeping and ejecting loose material, e. moving and guiding said cutting reel through said overlaid material areas until said overlaid material has been removed from said substrate.

18. The method of claim 17, wherein:

said cutting edges of said blade members of cutting reel are each distributed to describe a helix about said shaft so that said cutting edges make angular contact with said overlaid material when cutting said overlaid material in step (d).

* * * * *